US009705225B1

(12) United States Patent
Musick

(10) Patent No.: US 9,705,225 B1
(45) Date of Patent: Jul. 11, 2017

(54) ELECTRICAL CONNECTOR ASSEMBLY HAVING A PLURALITY OF ELECTRICAL SOCKET TERMINALS RETAINED WITHIN A SOCKET CARTRIDGE

(71) Applicant: DELPHI TECHNOLOGIES, INC., Troy, MI (US)

(72) Inventor: Steven A. Musick, Burton, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/233,310

(22) Filed: Aug. 10, 2016

(51) Int. Cl.

| | |
|---|---|
| ***H01R 13/502*** | (2006.01) |
| ***H01R 13/422*** | (2006.01) |
| ***H01R 24/20*** | (2011.01) |
| *H01R 107/00* | (2006.01) |
| *H01R 13/506* | (2006.01) |
| *H01R 24/76* | (2011.01) |
| *H01R 13/11* | (2006.01) |

(52) U.S. Cl.
CPC ..... *H01R 13/422* (2013.01); *H01R 24/20* (2013.01); *H01R 13/111* (2013.01); *H01R 13/506* (2013.01); *H01R 24/76* (2013.01); *H01R 2107/00* (2013.01)

(58) Field of Classification Search
USPC ..... 439/695, 738, 750, 851
See application file for complete search history.

(56) References Cited

U.S. PATENT DOCUMENTS

| | | | | |
|---|---|---|---|---|
| 4,565,416 | A * | 1/1986 | Rudy | H01R 13/4364 439/592 |
| 5,554,055 | A | 9/1996 | Miller | |
| 6,010,348 | A | 1/2000 | Alden | |
| 6,821,160 | B2 * | 11/2004 | Fink | H01R 13/512 439/595 |
| 8,257,120 | B2 * | 9/2012 | Shimizu | H01R 13/111 439/851 |
| 9,085,242 | B2 * | 7/2015 | Guillanton | H01R 13/111 |
| 2007/0275597 | A1 * | 11/2007 | Wang | H01R 13/506 439/587 |
| 2015/0147918 | A1 * | 5/2015 | Matsuda | B60L 11/18 439/694 |
| 2015/0333434 | A1 * | 11/2015 | Duquesne | H01R 13/521 439/587 |

* cited by examiner

*Primary Examiner* — Tho D Ta
(74) *Attorney, Agent, or Firm* — Robert J. Myers

(57) ABSTRACT

An electrical connector assembly is presented. The electrical connector assembly includes an electrical socket terminal having a frustoconical body that defines a first cylindrical cavity configured to receive a corresponding electrical plug terminal. The frustoconical body defines a plurality of axially slots extending to the first cylindrical cavity. The terminal further includes a cylindrical member extending from the frustoconical body. The cylindrical member defines a circumferential flange extending from an outer surface of the cylindrical member. The electrical connector assembly also includes a terminal cartridge formed of a dielectric material and defining a generally U-shaped slot having an open end, a closed end, two side walls, and a floor. The U-shaped slot is configured to receive the circumferential flange of the socket terminal. The floor defines a locking protrusion configured to contact the flange and retain the socket terminal within the U-shaped slot.

4 Claims, 3 Drawing Sheets

ELECTRICAL CONNECTOR ASSEMBLY HAVING A PLURALITY OF ELECTRICAL SOCKET TERMINALS RETAINED WITHIN A SOCKET CARTRIDGE

TECHNICAL FIELD OF INVENTION

The invention generally relates to electrical connector assemblies and more particularly relates to a connector assemblies having a plurality of electrical socket terminals retained within a socket cartridge.

BACKGROUND OF THE INVENTION

Electrical connector s, such as those used as charging couplers of electrical vehicle service equipment (EVSE), may contain female socket terminals that are configured to receive male plug terminals of a corresponding connector assembly, such as an electric vehicle's charging port. In order to provide the desired electrical and mechanical performance, these socket terminals are typically formed by machining the socket terminal from a solid bar of a metallic material. The socket terminals may define circumferential flanges that are designed to secure the socket terminals within the connector assembly as the electrical connector is assembled. The socket terminals may be subject to dislocation during the process of assembling the electrical connector. Therefore, a means of securing the socket terminals in their proper position as the electrical connector is being assembled is desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical connector assembly is provided. The electrical connector assembly includes an electrical socket terminal configured to mate with a corresponding electrical plug terminal having a frustoconical body that defines a first cylindrical cavity configured to receive the plug terminal. The frustoconical body defines a plurality of axially slots formed in an outer surface of the frustoconical body extending to the first cylindrical cavity. The terminal further includes a cylindrical member extending from the frustoconical body. The cylindrical member defines a circumferential flange extending from an outer surface of the cylindrical member. The electrical connector assembly also includes a terminal cartridge formed of a dielectric material and defining a generally U-shaped slot having an open end, a closed end, two side walls, and a floor. The U-shaped slot is configured to receive the circumferential flange of the socket terminal. The floor defines a locking protrusion configured to contact the flange and retain the socket terminal within the U-shaped slot.

A diameter of the circumferential flange is greater than a diameter of the cylindrical member and a maximum diameter of the frustoconical body.

The socket terminal may further include an elongate member extending from the cylindrical member and defining a second cylindrical cavity configured to receive a wire cable. A diameter of the elongate member is less than a diameter of the cylindrical member.

The frustoconical body, the cylindrical member, and the elongate member may be integrally formed from a solid bar of an electrically conductive material.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is an electrical connector assembly, such as a charging coupler of an electrical vehicle service equipment (EVSE) cord set, a socket terminal used in the connector assembly and a method of forming such a socket terminal. The socket terminals are crimped to the wire cables of the cord set. The socket terminals are retained in a connector cavity by a terminal cartridge, mat seal, and seal retainer.

Figure 1:
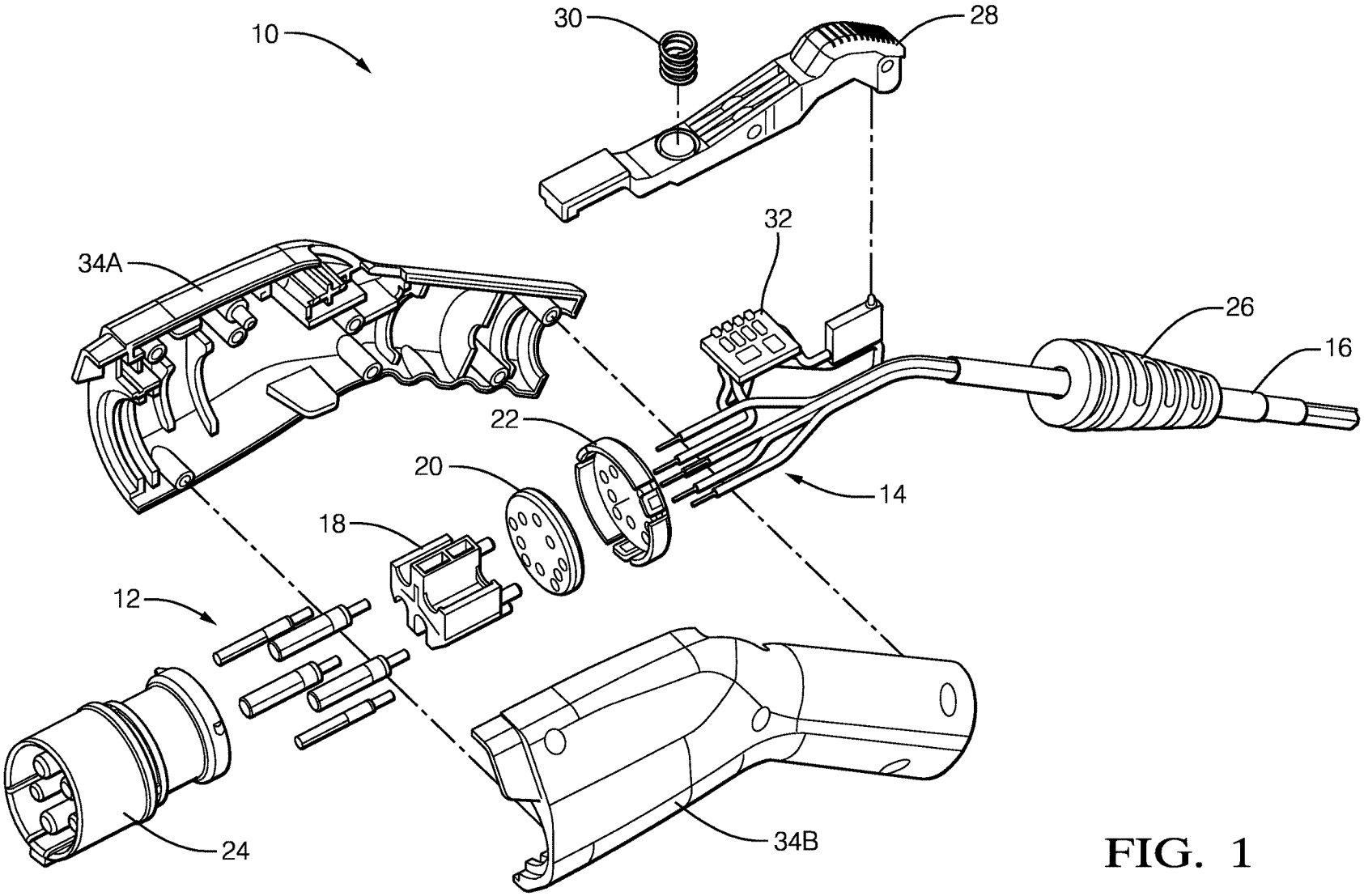
FIG. 1 is an exploded perspective view of an electrical connector assembly in accordance with one embodiment.

FIG. 1 illustrates a non-limiting example of an electrical connector assembly 10, such as a charging coupler of an electrical vehicle service equipment (EVSE) cord set conforming to the Society of Automotive Engineers (SAE) standard J-1772. The connector assembly 10 includes a plurality of female socket terminals 12 that are configured to receive the corresponding male plug terminals (not shown) of a corresponding charge port connector (not shown) of an electrical vehicle or plug-in hybrid electrical vehicle (not shown). The socket terminals 12 are each connected to a wire cable 14 of the EVSE cord 16 and are retained within a terminal cartridge 18. A mat seal 20 and seal retainer 22 are attached to the terminal cartridge 18 and then placed with a terminal retainer 24. The terminal cartridge 18, mat seal 20, and seal retainer 22 cooperate to provide terminal position assurance as the socket terminals 12 are placed within the terminal retainer 24. The mat seal 20, and seal retainer 22 also protect the socket terminal/wire cable interfaces from environmental contaminants. The connector assembly 10 further includes a strain relief grommet 26 around the EVSE cord 16, a connector release lever 28, lever spring 30, and micro-switch circuit board 32. The terminal retainer 24, release lever, lever spring 30, circuit board 32, and strain relief grommet 26 are all contained within a connector housing 34 which has two halves 34A, 34 B that are held together by fasteners, such as screws or rivets (not shown).

Figure 2A:
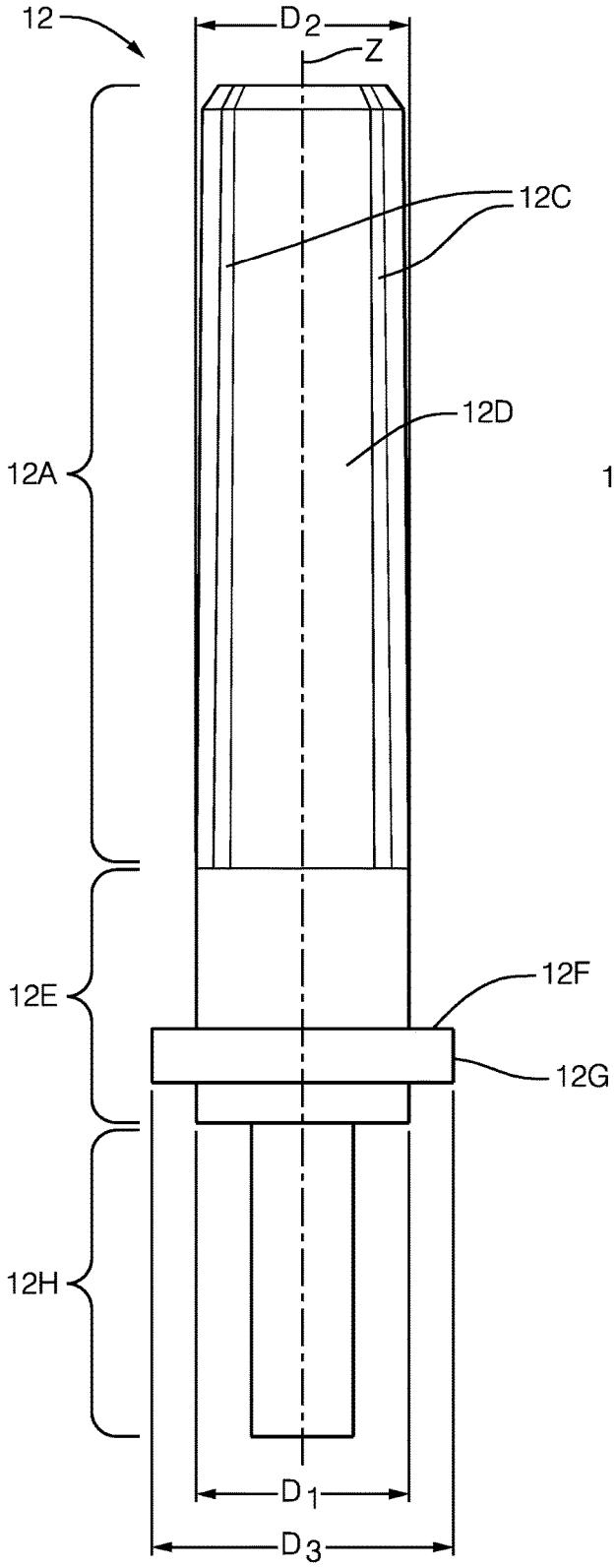
FIG. 2A is a side view of one of the socket terminals of the connector assembly of FIG. 1 in accordance with one embodiment.
Figure 2B:
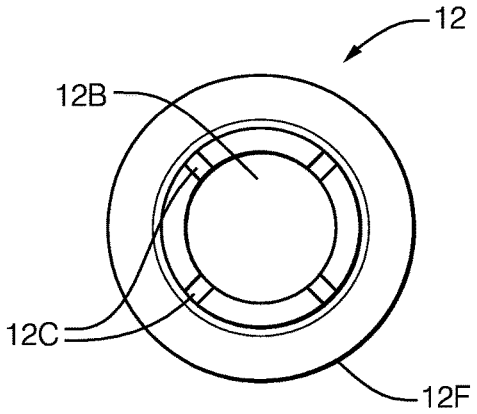
FIG. 2B is an top end view of one of the socket terminals of the connector assembly of FIG. 1 in accordance with one embodiment.
Figure 2C:
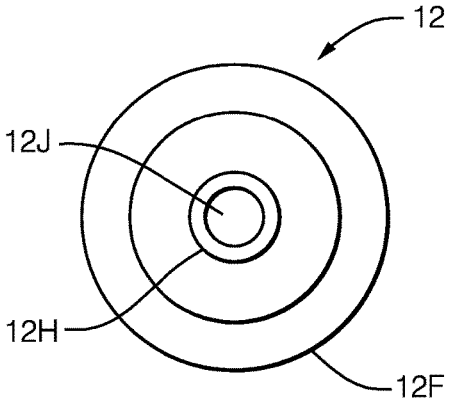
FIG. 2C is an bottom end view of one of the socket terminals of the connector assembly of FIG. 1 in accordance with one embodiment.

FIG. 2 illustrates a non-limiting example of a socket terminal 12. As shown in FIG. 2, the socket terminal 12 includes a frustoconical shaped terminal body 12A, hereinafter referred to as the body 12A, oriented along a longitudinal axis Z of the socket terminal 12. The body 12A defines a first cylindrical cavity 12B, hereinafter referred to as the first cavity 12B, oriented along the longitudinal axis Z that is configured to receive the corresponding plug terminal (not shown). The body 12A has two or more axially slots 12C running parallel to the longitudinal axis Z that are formed in an outer surface 12D of the body 12A and extend through the body 12A to the first cavity 12B. The socket terminal 12 in the illustrated example includes four axial slots 12C evenly spaced every 90° about the longitudinal axis Z. These axial slots 12C allow the body 12A to flex when the plug terminal is inserted within the first cavity 12B thereby applying a normal spring force to the plug terminal and providing a reliable electrical connection.

The socket terminal 12 also includes a cylindrical member 12E extending along the longitudinal axis Z from the body 12A. A diameter $D_1$ of the cylindrical member 12E is greater than or equal to a maximum diameter $D_2$ of the body 12A. In the illustrated example, the diameter $D_1$ of the cylindrical member 12E is greater than the maximum diameter $D_2$ of the body 12A. At least one circumferential flange 12F, hereinafter referred to as a flange 12F, having side walls substantially perpendicular to the outer surface 12D of the cylindrical member 12E and a top wall 12G substantially parallel perpendicular to the outer surface 12D of the cylindrical member 12E is defined in the outer surface 12D of the cylindrical member 12E. As used herein, substantially perpendicular means±30° of absolutely perpendicular and substantially parallel means±10° of absolutely parallel. The diameter $D_3$ of the flange 12F, i.e. the diameter of the top wall 12G of the flange 12F, is greater than than the diameter $D_1$ of the cylindrical member 12E.

The socket terminal 12 further includes an elongate crimping member 12H extending from the cylindrical member 12E. The crimping member 12H defines a second cylindrical cavity 12J, hereinafter referred to as the second cavity 12J, aligned along the longitudinal axis Z that is configured to receive a wire cable 14. After a portion of the wire cable 14 is placed in the second cavity 12J, at least a portion of the crimping member 12H is crushed in order to crimp the wire cable 14 within the second cavity 12J, thereby mechanically and electrically attaching the socket terminal 12 to the wire cable 14.

The body 12A, the cylindrical member 12E, and the crimping member 12H of the illustrated socket terminal 12 are integrally formed from a solid bar (not shown) of an electrically conductive material, such as a copper alloy, and are silver plated to assure a reliably low resistance connection between the socket terminal 12 and the corresponding plug terminal.

Figure 3:
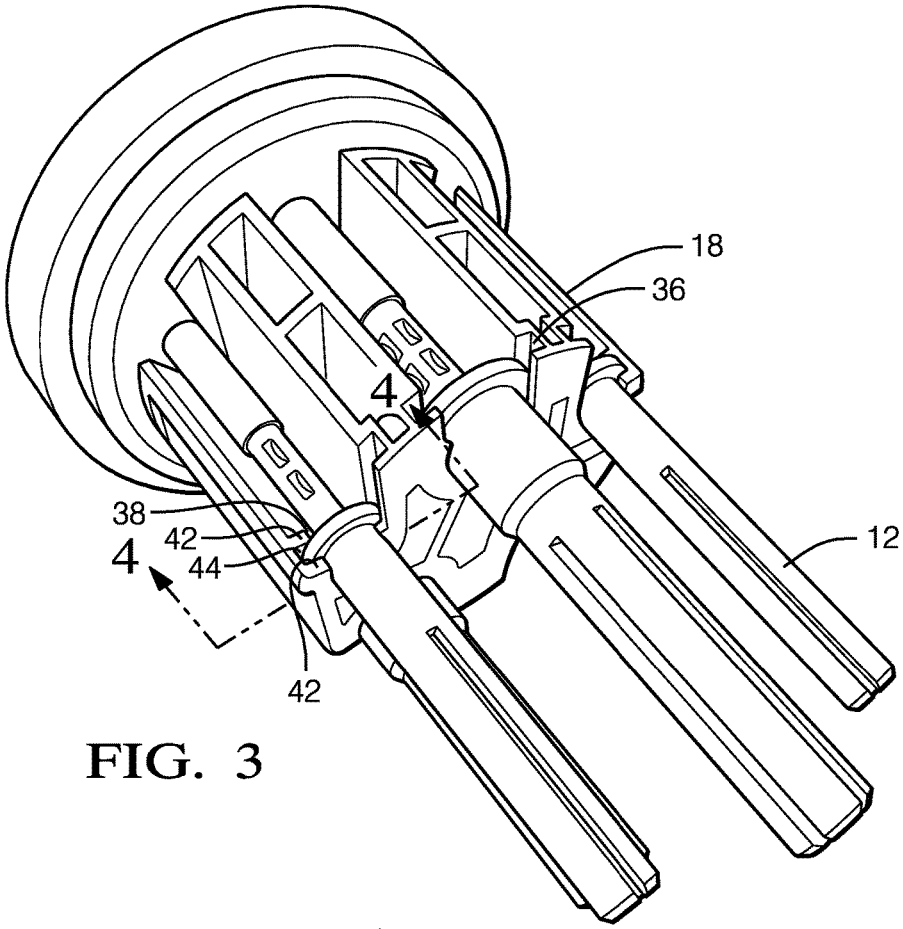
FIG. 3 is perspective view of the socket terminals of the connector assembly of FIG. 1 within a terminal cartridge in accordance with one embodiment.
Figure 4:
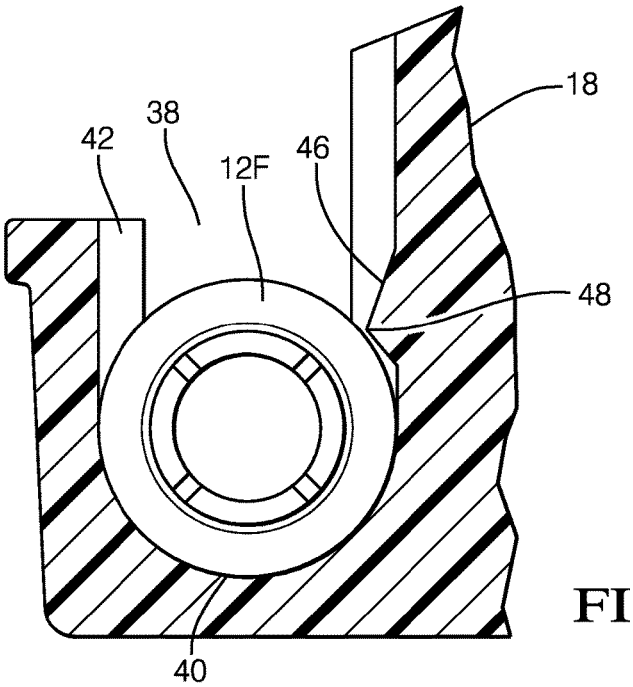
FIG. 4 is a partial cross section view of the socket terminals of the connector within the terminal cartridge of FIG. 3 in accordance with one embodiment.

The terminal cartridge 18 is formed of a resilient dielectric material, e.g. an engineering plastic. As illustrated in FIGS. 3 and 4, the terminal cartridge 18 defines a number of generally U-shaped slots 36 that have an open end 38, a closed end 40, two side walls 42, and a floor 44. The U-shaped slot 36 is configured to receive the flange 12F of the socket terminal 12 within the open end 38. The floor 44 defines a locking protrusion 46 configured to contact the flange 12F and retain the socket terminal 12 within the U-shaped slot 36. The locking protrusion 46 has a generally triangular cross section. The base surface of the protrusion is attached to the floor 44 of the slot. The entry surface and the retaining surface project from the floor 44 of the slot. Without subscribing to any particular theory of operation, as the flange 12F is inserted into the slot, the top wall 12G of the flange 12F contacts the entry surface, a force applied to the terminal causes the cartridge to flex outwardly and increasing the width of the slot until the flange 12F is pushed past the apex 48 formed by the entry surface and the retaining surface. After the flange 12F is pushed past the apex 48, the cartridge resiliently return to its original shape and the slot to its original width. The terminal is then retained within the cartridge by the contact of the flange 12F with the retaining surface of the locking protrusion 46.

In alternative embodiments of the invention, the locking protrusion may be defined by one or both of the side walls of the slot rather than the floor.

As shown in FIGS. 1 and 3, the connector assembly 10 may include socket terminals having varying diameters in order to comply with different current carrying requirements. As can be seen in FIG. 3, the length of the terminal bodies, cylindrical members, and crimping members may also vary as the diameters of the socket terminals are varied.

Accordingly, an electrical connector assembly 10 is provided. The socket terminals of the assembly are held within U-shaped slots in the terminal cartridge provides the benefit of retaining the terminals within the terminal cartridge during the assembly process, thus reducing labor time and improving product quality.

While this invention has been described in terms of the preferred embodiments thereof, it is not intended to be so limited, but rather only to the extent set forth in the claims that follow. Moreover, the use of the terms first, second, upper, lower, etc. does not denote any order of importance or orientation, but rather the terms first, second, upper, lower, etc. are used to distinguish one element from another. Furthermore, the use of the terms a, an, etc. do not denote a limitation of quantity, but rather denote the presence of at least one of the referenced items.

I claim:

1. An electrical connector assembly, comprising:

an electrical socket terminal configured to mate with a corresponding electrical plug terminal having a frustoconical body that defines a first cylindrical cavity configured to receive the plug terminal, wherein the frustoconical body defines a plurality of axially slots formed in an outer surface of the frustoconical body extending to the first cylindrical cavity, wherein the socket terminal further includes a cylindrical member extending from the frustoconical body, and wherein the cylindrical member defines a circumferential flange extending from an outer surface of the cylindrical member; and a terminal cartridge formed of a dielectric material and defining a generally U-shaped slot having an open end, a closed end, two side walls, and a floor, wherein the U-shaped slot is configured to receive the circumferential flange of the socket terminal and wherein the floor defines a locking protrusion configured to contact the flange and retain the socket terminal within the U-shaped slot.

2. The electrical connector assembly according to claim 1, wherein a diameter of the circumferential flange is greater than a diameter of the cylindrical member and a maximum diameter of the frustoconical body.

3. The electrical connector assembly according to claim 2, wherein the socket terminal further comprises an elongate member extending from the cylindrical member and defining a second cylindrical cavity configured to receive a wire cable and wherein a diameter of the elongate member is less than the diameter of the cylindrical member.

4. The electrical connector assembly according to claim 3, wherein the frustoconical body, the cylindrical member, and the elongate member are integrally formed from a solid bar of an electrically conductive material.

* * * * *